US006317955B1

(12) United States Patent
Wada et al.

(10) Patent No.: US 6,317,955 B1
(45) Date of Patent: Nov. 20, 2001

(54) METHOD OF PRODUCING A RESINOUS DOME FORMING MOLD

(75) Inventors: Jyoji Wada, Yokohama; Kazushige Tamura, Sagamihara, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/274,295

(22) Filed: Mar. 23, 1999

(30) Foreign Application Priority Data

Apr. 8, 1998 (JP) ..... 10-095629

(51) Int. Cl.[7] ..... B23P 17/00; B24B 9/00
(52) U.S. Cl. ..... 29/425; 451/123; 451/50
(58) Field of Search ..... 425/469; 29/425, 29/428, 445, 464, 466, 90.01; 451/460, 42, 123, 255, 256, 50

(56) References Cited

U.S. PATENT DOCUMENTS

| | | | | |
|---|---|---|---|---|
| 1,588,435 | * | 6/1926 | Adams | 451/256 |
| 1,994,529 | * | 3/1935 | Meyer | 451/123 |
| 2,151,233 | * | 3/1939 | Rowe | 451/460 |
| 2,836,939 | * | 6/1958 | White | 451/285 |
| 2,982,057 | * | 5/1961 | Stanhope | 451/50 |
| 3,079,739 | * | 3/1963 | Rawstron | 451/42 |
| 3,167,884 | * | 2/1965 | Thompson | 451/50 |
| 3,830,021 | * | 8/1974 | Blum et al. | 451/390 |
| 3,835,528 | * | 9/1974 | Garrett | 29/560 |
| 3,871,813 | * | 3/1975 | Cappeli | 425/469 |
| 3,877,184 | * | 4/1975 | Billault et al. | 451/42 |
| 4,178,720 | * | 12/1979 | Hashimoto | 451/276 |
| 5,024,024 | * | 6/1991 | Watanabe | 451/42 |
| 5,140,777 | * | 8/1992 | Ushiyama et al. | 451/5 |
| 5,299,394 | * | 4/1994 | Surdacki | 451/50 |
| 5,562,527 | * | 10/1996 | Nauche | 451/9 |
| 5,907,905 | * | 6/1999 | Lee | 29/898.042 |
| 5,951,375 | * | 9/1999 | Mandler | 451/42 |
| 6,119,763 | * | 9/2000 | Inoue et al. | 164/516 |
| 6,126,520 | * | 10/2000 | Jochim-Schmidt et al. | 451/42 |
| 6,129,611 | * | 10/2000 | Yamaguchi | 451/50 |

FOREIGN PATENT DOCUMENTS 5-104642 4/1993 (JP) .

* cited by examiner

*Primary Examiner*—S. Thomas Hughes
*Assistant Examiner*—Marc Jimenez
(74) *Attorney, Agent, or Firm*—Louis Woo

(57) ABSTRACT

A method of forming a mold for forming a resinous domed article which may be employed as a cover of a monitor camera is provided. The mold consists of a female block and a male block. The female block has formed therein a domed mold cavity which includes a hemispherical wall that is just half a sphere and an annular wall extending from an end of the hemispherical wall. The male block has a domed protrusion mating with the domed mold cavity of the female block. The domed protrusion consists of two parts; a hemispherical portion and a cylindrical portion. The hemispherical portion is mechanically joined to the cylindrical portion. This structure allows the surface of the domed protrusion of the male block to be formed smoothly without any irregularities on an interface between the hemispherical portion and the cylindrical portion.

1 Claim, 4 Drawing Sheets

METHOD OF PRODUCING A RESINOUS DOME FORMING MOLD

BACKGROUND OF THE INVENTION

1. Technical Field of the Invention

The present invention relates generally to a mold for molding resinous domed articles which may be employed as a cover for monitor cameras, and more particularly to a production method of the same.

2. Background Art

Typical monitor cameras employed in stores, banks, etc. are designed to monitor a preselected range across a fixed direction. Cameras of this type have a dead angle so great as not to cover a wide range. In order to avoid this problem, there have been developed monitor devices which turns or pans a single camera horizontally and tilts it vertically for monitoring a wider range. Such prior art monitor cameras are usually suspended from the ceiling and present an appearance persons perceive to be a camera easily, thus giving an unpleasant feeling to customers in the store. Recently, small-sized monitor cameras are, thus, proposed whose major part of the camera and tilt and pan mechanisms are covered with a resinous dome.

FIG. 4 shows such a dome-shaped monitor camera which includes a camera body 1, a mount ring 2, a transparent domed cover 3, an inner cover 4, a camera lens 5, a power supply cable 6, and an output coaxial cable 7. The inner cover 4 is disposed within the domed cover 3 and made from an opaque or a translucent material. The inner cover 4 has formed therein an opening 4a through which the camera lens 5 faces the outside. The power supply cable 6 supplied the power to the camera body 1, a tilt mechanism, and a pan mechanism. The output cable 7 outputs image signals and receives control signals. The domed cover 3 is made from acrylate resin in injection molding and required to have smooth surfaces and a constant thickness for ensuring a given degree of quality of captured images. The domed cover 3 is also required to have substantially a hemispherical surface for vertical and horizontal movements of the camera body 5 over 90° and 360° ranges, respectively.

FIG. 5 shows a conventional mold for forming the domed cover 3 shown in FIG. 4. The mold consists of an upper block 8 (i.e., a female molding block) and a lower block 9 (i.e., a male molding block). The upper block 8 has formed therein a cavity 10 which consists of a hemispherical wall 10a and an annular wall 10*b* extending straight from an end of the hemispherical wall 10*a*.

The formation of the cavity 10 of the upper block 8 is achieved by rotating the upper block 8 about a vertical axis V passing through the center 0 of a semicircle having the same radius of curvature as that of the hemispherical wall 10 and rotating and moving a grindstone, which has a surface curved outward with the same radius of curvature as that of the hemispherical wall 10*a*, from the top to an end of the semicircle. The annular wall 10*b* of the upper block 8 is grounded by moving the grindstone parallel to the vertical axis V. A hemispherical portion 9*a* of the lower block 9 may be grounded in substantially the same manner as that of forming the cavity 10, but formation of an annular wall 9*b* extending straight from an end of the hemispherical portion 9*a* requires interruption of the grinding and replacement of the grindstone used in forming the hemispherical portion 9*a* with another one having a flat grinding surface. This is because a comer between the annular wall 9*b* and a flat upper wall 9*c* needs to be formed at right angles. The replacement of the grindstone may result in an error in forming a curved outer surface near an end of the hemispherical portion 9*a* , thereby causing irregularities to be formed on an interface between the hemispherical portion 9*a* and the annular wall 9*b* , which will lead to formation of similar irregularities on an inner surface of the domed cover 3 near its end, thereby contributing to distortion of part of images captured by the monitor camera.

SUMMARY OF THE INVENTION

It is therefore a principal object of the present invention to avoid the disadvantages of the prior art.

It is another object of the present invention to provide a resinous dome-forming mold having smooth surfaces which do not form irregularities on the surfaces of molded articles.

According to one aspect of the invention, there is provided a mold for forming a resinous domed article including a hollow hemispherical portion and a hollow cylindrical portion continuing from an end of the hollow hemispherical portion. The mold comprises: (a) a female block having formed therein a domed mold cavity which includes a hemispherical wall that is just half a sphere and an annular wall extending from an end of the hemispherical wall; and (b) a male block having a domed protrusion mating with the domed mold cavity of the female block. The domed protrusion includes a hemispherical portion and a cylindrical portion which is joined to the hemispherical portion.

According to the second aspect of the invention, there is provided a method of producing a male block of a resinous domeforming mold. The male block has a dome-shaped protrusion which includes a hemispherical section that is just half a sphere and a cylindrical section continuing from an end of the hemispherical section. The method comprises the steps of: (a) preparing a spherical block having a spherical surface ranging over at least more than half a sphere; (b) rotating the spherical block around an axis passing through the center of the spherical block; (c) grinding an area of the spherical surface of the spherical block ranging over more than 180° from a top of the spherical surface through which the axis of rotation passes to a circumference thereof using a grindstone with a curved surface having substantially the same radius of curvature as that the hemispherical section of the male block; (d) cutting off a grounded portion of the spherical block to complete the hemispherical section of the male block; (e) preparing a block on which the cylindrical section of the male block is formed; and (f) joining the cylindrical section to the hemispherical section to complete the male block.

According to the third aspect of the invention, there is provided a method of producing a male block of a resinous dome-forming mold. The male block has a dome-shaped protrusion which includes a hemispherical section that is just half a sphere and a cylindrical section continuing from an end of the hemispherical section. The method comprises the steps of: (a) preparing a spherical block including a hemispherical portion that is just half a sphere and a base portion connected to the hemispherical portion to form a spherical surface ranging over more than 180° of the sphere; (b) rotating the spherical block around an axis passing through the center of the spherical block; (c) grinding an area of the spherical surface of the spherical block ranging over more than 180° from a top of the spherical surface through which the axis of rotation passes to a circumference thereof using a grindstone with a curved surface having substantially the same radius of curvature as that the hemispherical section of the male block; (d) separating the hemispherical portion from the spherical block to complete the hemispherical section of the male block; (e) preparing a block on which the cylindrical section of the male block is formed; and (i) joining the cylindrical section to the hemispherical section to complete the male block.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 2(*b*) is an illustration which shows joining of the hemispherical portion grounded in FIG. 2(*a*) to a cylindrical protrusion to complete the male block shown in FIG. 1;

FIG. 3(*b*) is an illustration which shows joining of the hemispherical portion grounded in FIG. 3(*a*) to a cylindrical protrusion to complete the male block shown in FIG. 1;

DESCRIPTION OF THE PREFERRED EMBODIMENTS

Figure 1:
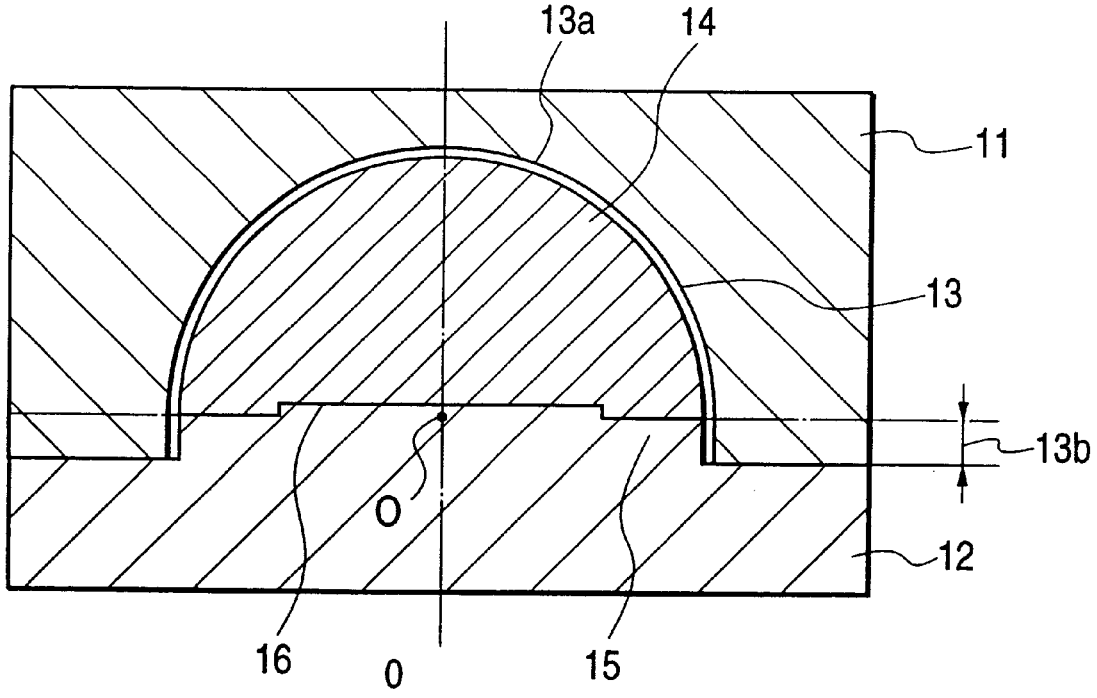
FIG. 1 is a vertical cross sectional view which shows a mold for forming resinous domed articles according to the present invention.
Figure 4:
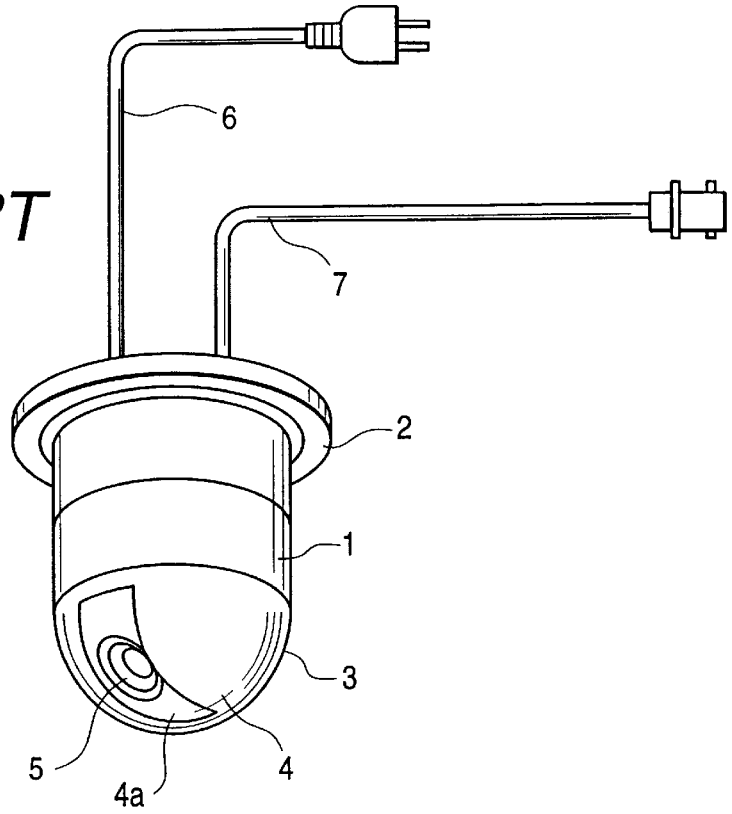
FIG. 4 PRIOR ART
FIG. 4 is a perspective view which shows a typical monitor camera with a resinous domed cover.
Figure 5:
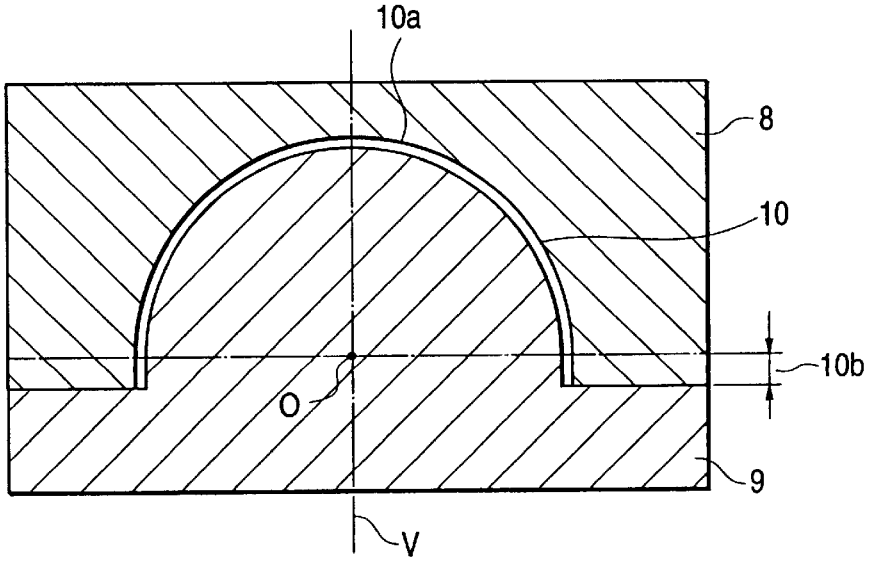
FIG. 5 PRIOR ART
FIG. 5 is a vertical cross sectional view which shows a conventional mold for forming the resinous domed cover as shown in FIG. 4.

Referring now to the drawings, particularly to FIG. 1, there is shown a die or mold which may be employed in injection molding for forming a resinous domed cover, like the one shown in FIG. 4, having a hemispherical portion and a hollow cylindrical portion continuing from an end of the hemispherical portion. The mold consists of a female block 11 and a male block 12. The female block 11 has a plane surface in which a mold cavity 13 is formed. The mold cavity 13 consists of a hemispherical wall 13*a* that is just half a sphere and an annular wall 13*b* extending straight from an end of the hemispherical wall 13*a*. The male block 12 includes a protrusion mating with the mold cavity 13 of the female block 11. The protrusion includes a hemispherical portion 14 and a cylindrical portion 15. The cylindrical portion 15 has a spigot joint 16 for attachment of the cylindrical portion 15 to the hemispherical portion 14 in alignment thereof.

Figure 2A:
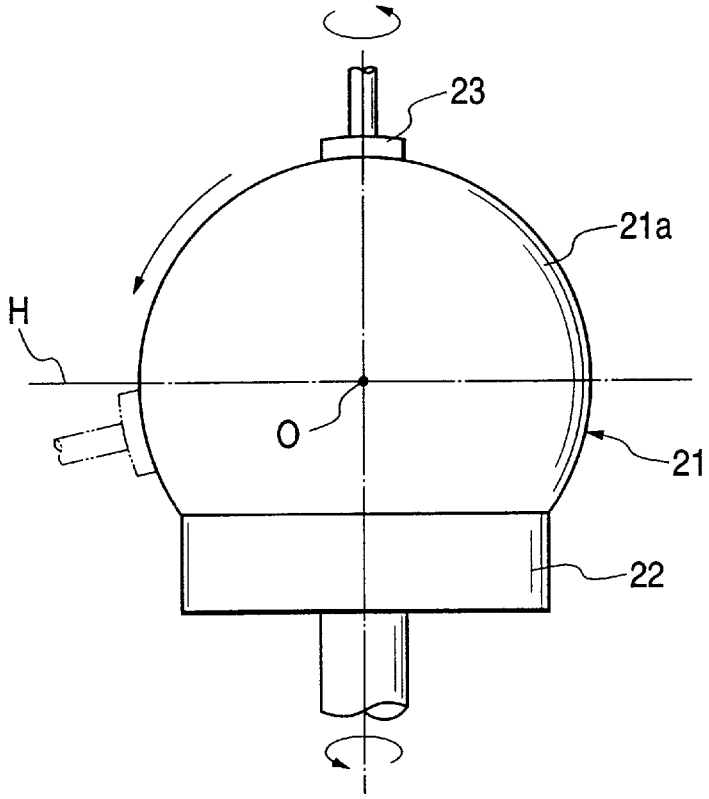
FIG. 2(*a*) is an illustration which shows grinding of a hemispherical portion of a male block of the mold shown in FIG. 1.
Figure 2B:
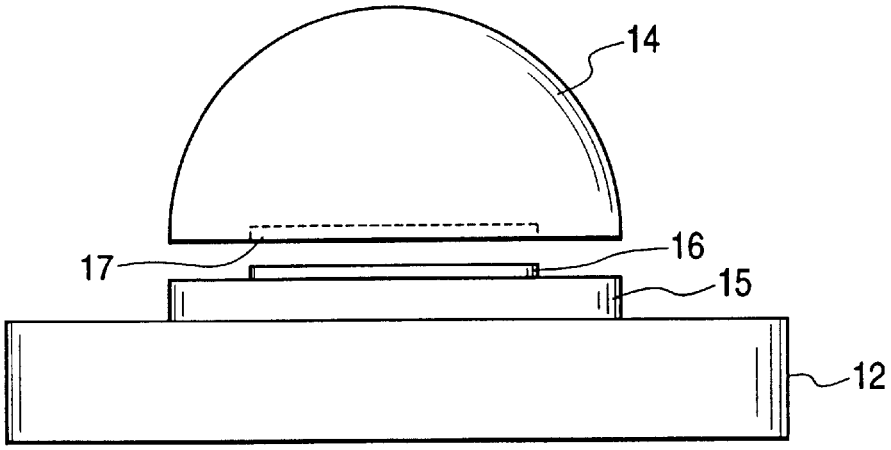

In production of the male block 12, a spherical block 21 which has, as shown in FIG. 2(*a*), a spherical wall ranging over more than 180° is first made using a grinding machine. The spherical block 21 is held by a rotary chuck 22 in electromagnetic or vacuum attachment in alignment of the center 0 thereof with an axis of rotation of the chuck 22.

Next, the chuck 22 is rotated. A grindstone 23 having a grinding surface curved inwardly with a radius of curvature equal to that of the hemispherical portion 14 is also rotated and moved, as indicated by an arrow in FIG. 2(*a*), from the top of the spherical block 21 through which the axis of rotation of the chuck 22 passes to the circumference thereof over a range of more than 180° in contact with the surface of the spherical block 21 to finish a hemispherical portion 21 a having the same radius of curvature as that of a molded product. The thus grounded spherical block 21 is cut along a horizontal line H to cut off the hemispherical portion 21*a* as the hemispherical portion 14 of the male block 12.

The bottom of the hemispherical portion 14 is machined to form a recess 17, as shown in FIG. 2(*b*).

The formation of the cylindrical portion 15 and the spigot joint 16 of the male block 12 is achieved in a known manner by machining a workpiece using, for example, a lathe.

Finally, the spigot joint 16 formed on the cylindrical portion 15 is fitted into the recess 17 in the bottom of the hemispherical portion 14 and bonded together to complete the male block 12. This allows the hemispherical portion 14 and the cylindrical portion 15 to be connected together without formation of irregularities on an interface therebetween, so that a domed product having a smooth surface can be molded.

Figure 3A:
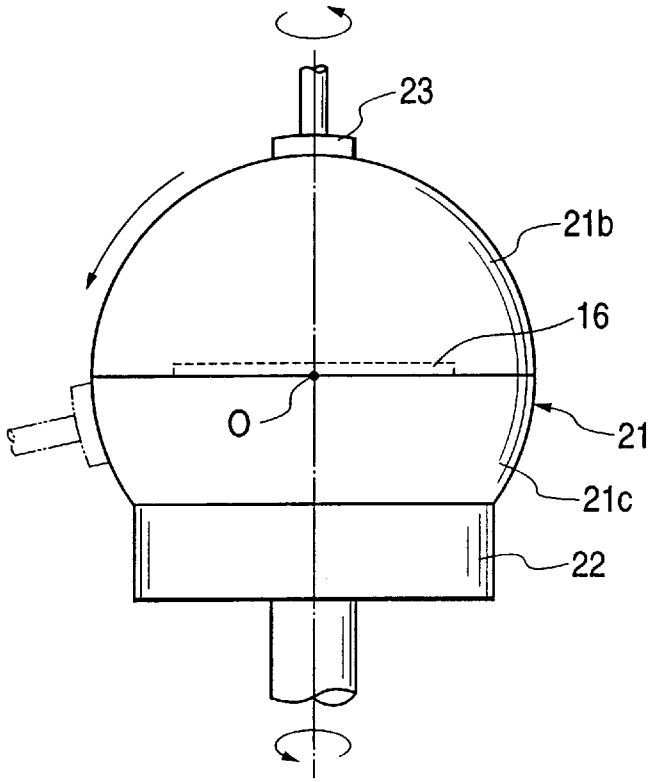
FIG. 3(*a*) is an illustration which shows grinding of a hemispherical portion of a male block of the mold shown in FIG. 1 according to the second embodiment of the invention.
Figure 3B:
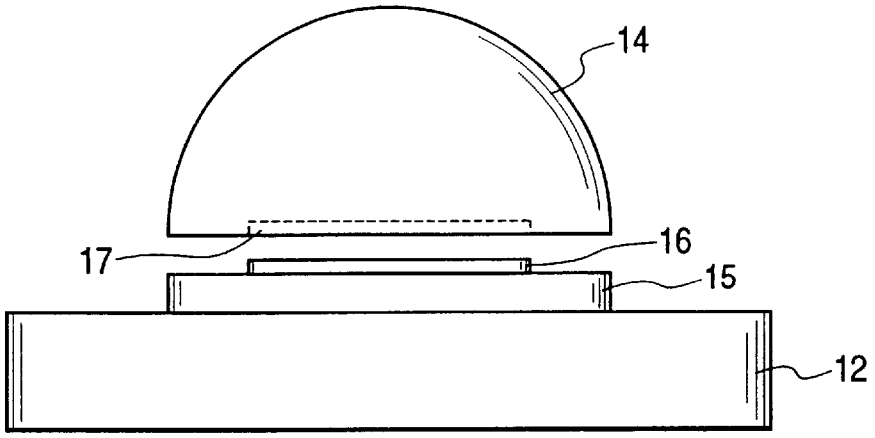

FIGS. 3(*a*) and 3(*b*) show a modification of the production method of the male block 12 which is different from the above first embodiment in that the spherical block 21 consists of two parts: a hemispherical portion 21*b* and a base block 21*c* to be gripped by the rotary chuck 22. Other arrangements are identical, and explanation thereof in detail will be omitted here.

The base block 21*c* has a flat surface on which the spigot joint 16 is formed. The spigot joint 16 is fitted into the mating recess 17 machined in a flat bottom of the hemispherical portion 21*b* to complete the spherical block 21. The spherical block 21 is held by the rotary chuck 22 and grounded in the same manner as that in the first embodiment to finish the hemispherical portion 21*b*. The hemispherical portion 21*b* is separated from the base block 21*c* as the hemispherical portion 14. The hemispherical portion 14 is connected to the cylindrical portion 15 in tight engagement of the spigot joint 16 with the recess 17 to complete the male block 12.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A method of producing a male block of a resinous dome-forming mold, the male block having a dome-shaped protrusion which includes a hemispherical section that is just half a sphere and a cylindrical section continuing from an end of the hemispherical section, comprising the steps of:

preparing a spherical block including a hemispherical portion that is just half a sphere and a base portion connected to the hemispherical portion to form a spherical surface ranging over more than 180° of the sphere;

rotating said spherical block around an axis passing through the center of said spherical block;

grinding an area of the spherical surface of said spherical block ranging over more than 180° from a top of the spherical surface through which the axis of rotation passes to a circumference thereof using a grindstone with a curved surface having substantially the same radius of curvature as that of the hemispherical section of the male block:

separating the hemispherical portion from said spherical block to complete the hemispherical section of the male block;

preparing a cylindrical section of the male block; and joining the cylindrical section to the hemispherical section to complete the male block.

* * * * *